US005806772A

United States Patent [19]

Karra

[11] Patent Number: 5,806,772

[45] Date of Patent: Sep. 15, 1998

[54] CONICAL GYRATORY GRINDING AND CRUSHING APPARATUS

[75] Inventor: Vijia Kumar Karra, Franklin, Wis.

[73] Assignee: Nordberg, Inc., Milwaukee, Wis.

[21] Appl. No.: 754,854

[22] Filed: Nov. 22, 1996

[51] Int. Cl.[6] ..... B02C 2/04

[52] U.S. Cl. ..... 241/57; 241/216; 241/DIG. 30

[58] Field of Search ..... 241/207–216, 241/DIG. 30, 37, 101.2, 91, 93, 94, 83, 21, 38, 265, 202, 264, 57

[56] References Cited

U.S. PATENT DOCUMENTS

| | | | |
|---|---|---|---|
| 1,254,192 | 1/1918 | Bartley | 241/83 |
| 2,134,876 | 11/1938 | Hull et al. | 241/216 |
| 2,224,542 | 12/1940 | Gruender et al. | 241/216 |
| 3,454,230 | 7/1969 | Allen | 241/214 |
| 4,192,472 | 3/1980 | Johnson | 241/216 |
| 4,359,208 | 11/1982 | Kelm et al. . | |
| 4,384,684 | 5/1983 | Karra . | |
| 4,391,414 | 7/1983 | Reiter | 241/216 |
| 4,406,416 | 9/1983 | Tateishi | 241/264 |
| 4,560,113 | 12/1985 | Szalanski . | |
| 4,575,014 | 3/1986 | Szalanski et al. . | |
| 4,620,185 | 10/1986 | Plahmer . | |
| 4,658,638 | 4/1987 | Plahmer . | |
| 4,659,026 | 4/1987 | Krause et al. . | |
| 4,750,679 | 6/1988 | Karra et al. | 241/202 |
| 4,756,484 | 7/1988 | Bechler et al. . | |
| 4,956,078 | 9/1990 | Magerowski et al. . | |
| 5,029,761 | 7/1991 | Bechler . | |

FOREIGN PATENT DOCUMENTS

| | | | |
|---|---|---|---|
| 0039261 | 3/1979 | Japan | 241/264 |
| 425642 | 2/1975 | U.S.S.R. | 241/214 |
| 1338883 | 9/1987 | U.S.S.R. | 241/264 |
| 1570015 | 6/1980 | United Kingdom | 241/216 |

*Primary Examiner*—Mark Rosenbaum
*Attorney, Agent, or Firm*—Foley & Lardner

[57] ABSTRACT

A conical gyratory grinder-crusher having a rigidly supported outer frustroconically shaped grinding-crushing member and an inner conical grinding member supported on a wobble mechanism which is in turn adjustably supported by air bellows so as to adjust the spacing between the inner and outer grinding-crushing members defining the grinding-crushing cavity, and therefore the particle size of the ground material. The bottom of the grinding-crushing cavity is closed by a flexible member. The flexible member seals the bottom of the grinding-crushing cavity. A slurry of fines or ground material is discharged from the grinder-crusher through grate discharge outlets provided in the lower portion of the inner conical grinding-crushing member.

19 Claims, 3 Drawing Sheets

CONICAL GYRATORY GRINDING AND CRUSHING APPARATUS

CROSS REFERENCE TO RELATED APPLICATIONS

The present application is related to U.S. patent application Ser. No. 08/754,925, filed by Karra on an even date herewith, entitled, "Conical Gyratory Mill For Fine Or Regrinding"; and U.S. patent application Ser. No. 08/754,924, filed by Karra on an even date herewith, entitled, "High Reduction Ratio Crushing In Conical/Gyratory Crushers.

FIELD OF THE INVENTION

This invention relates to a conical gyratory grinding and crushing apparatus of simplified construction and greater operational efficiency than currently available grinders.

BACKGROUND OF THE INVENTION

Various types of machines have been provided in the past for grinding and crushing operations. Conventional tumbling mills are notoriously energy inefficient for crushing and grinding operations. Crushing or grinding in tumbling mills is accomplished principally by impact, which is most effective only at the toe of the tumbling bed. Recently introduced roll presses are wear intensive due to the relative motion between the feed stock, i.e. the material to be ground, and the rotating surface of the rolls. Vertical roller mills are generally used for dry grinding of softer (low abrasive) minerals or ores and are at times not desirable because of their considerable vertical height. Large diameter, short length, autogenous or semi-autogenous mills, another version of tumbling mills, are frequently not able to grind critical size, rounded material. Conventional cone crushers have been used to crush the critical size material as an addition to the autogenous or semi-autogenous mill circuit, thereby complicating the flowsheet and equipment maintenance requirements.

Overall, grinding based on "compressive" load application, such as in roll, jaw, and conical, gyratory crushers is more energy efficient, particularly when relative motion between the feed stock and the load application surfaces of the device can be avoided or minimized. Thus, there is a need for an energy efficient conical, gyratory grinding and crushing apparatus which maintains flowsheet simplicity without involving an additional crusher for critical size crushing, and which grinds materials via compressive forces.

SUMMARY OF THE INVENTION

The present invention relates to a grinder-crusher including a main support member and a conical bowl supported on the main support member. A conical head is utilized with the grinder-crusher and includes a load application surface having an upper and lower end. The conical head receives a flexible seal adjacent to the lower end.

The present invention further relates to a grinder-crusher including a main frame, a bowl support on the main frame, a gyrating head and a sealing means. The bowl has an upper end and a lower end, and the head has an upper end and a lower end. The head and the bowl define a grinding-crushing cavity. The sealing means inhibits material from leaving the lower end of the grinding-crushing cavity.

It is an aspect of this invention to provide a conical gyratory grinding and crushing apparatus, for certain types of grinding and crushing applications, which utilizes the energy efficient compressive comminution, and avoids to a large extent relative motion between the material being ground and the walls of the grinding and crushing apparatus. It is another aspect of the invention to provide a conical gyratory grinding and crushing apparatus which has grate discharge outlets in the lower portion of the mantle or inner grinding member for the discharge of fines or ground material in slurry form from the grinding-crushing cavity. It is still another aspect of this invention is to provide a conical gyratory grinding and crushing apparatus wherein the grinding-crushing can be done interparticle without any grinding media, i.e. autogenous mode, or with the aid of a media such as coarse ore/pebbles or steel or ceramic. It is a further aspect of this invention to provide a grinder-crusher, suitable for certain grinding operations, which has improved operational efficiencies, particularly with respect to energy usage and operational maintenance costs.

In accordance with this invention, a grinder-crusher is provided in which the grinding is essentially accomplished by compressive forces and resulting attrition, with very minimal relative motion between ground material and surfaces of the grinder-crusher. Further, there is no build-up of critical size material. Unlike a conventional cone crusher, the inner grinding member or mantle liner has grate-discharge outlets in its lower portion for discharge of ground material in slurry form from the grinding cavity. In a second embodiment of the invention, discharge of the ground fines from the grinder-crusher is accomplished by air flowing upward through the grinding cavity and discharge from the top of the grinder-crusher, rather than by slurry flow through grate-discharge outlets in the mantle.

The inner grinding-crushing member, is caused to gyrate or wobble within a frustroconically shaped downwardly spreading outer grinding-crushing member by a wobble mechanism, driven by a vertical rotating shaft. Material flowing downwardly between the inner and outer grinding or crushing members in the cavity is ground or crushed therebetween. The wobble mechanism includes a pair of members, a lower one of which is caused to rotate by the driven vertical rotating shaft, and an upper one of which is supported for rotation upon the lower one by a bearing assembly. The top surface of the lower member is in a plane which is not perpendicular to the axis of the vertical shaft. Thus, the upper member, the bottom surface of which rests on the top surface of the lower member, and which is prevented from rotation, will wobble as the lower member rotates. Rotation of the upper member is prevented by a first generally cylindrical bellows assembly, one end of which is indirectly secured to fixed part of the grinder-crusher, and the other end of which is indirectly secured to the upper member.

The wobble mechanism, and therefore the inner grinding-crushing member, is supported so as to be vertically adjustable with respect to the base of the grinder. By adjusting the vertical position of the inner grinding-crushing member, its position with respect to the outer grinding-crushing member is adjusted, to increase or decrease the average width of the grinding space between the inner and outer grinding-crushing members. In a preferred embodiment, the vertical adjustment is provided by an air bellows assembly. By regulating the air pressure in the air bellows, the relative height of the wobble mechanism with respect to the base of the grinder-crusher may be adjusted. The eccentric throw of the inner grinding-crushing member and the rotational speed of the wobble drive mechanism are chosen to promote interparticle or bed comminution.

A second bellows assembly closes the bottom of the grinding-crushing cavity, such that material can not be discharged through the bottom of the cavity. The second bellows assembly, formed of increasing diameter concentric rubber bellows segments and joining rings, the largest diameter end of which is non-leakingly attached to bottom end of outer grinding-crushing member where it is attached to the supporting wall, and the smallest diameter bellow segment of which is attached to the bottom edge of the inner grinding-crushing member.

A ground material deflector or slurry guide, can be in the form of a conical frustum. The ground material or slurry deflector serves to direct the slurry containing fines or ground material which flows through the grate-discharge outlets in the inner grinding-crushing member away from the anti-spin functioning bellows thereby providing protection from abrasive damage by the slurry.

In an alternate embodiment of the invention, neither grates in the inner grinding-crushing member nor a ground material deflector is provided. Rather, an air distribution ring is provided to supply air to tuyeres or nozzles located at the bottom of the grinding-crushing cavity. Air flow through the tuyeres provides an air stream which lifts and carries the fines and ground material for discharge from the top of the grinding-crushing cavity into an exit duct.

DETAILED DESCRIPTION OF THE PREFERRED EMBODIMENTS

Figure 1:
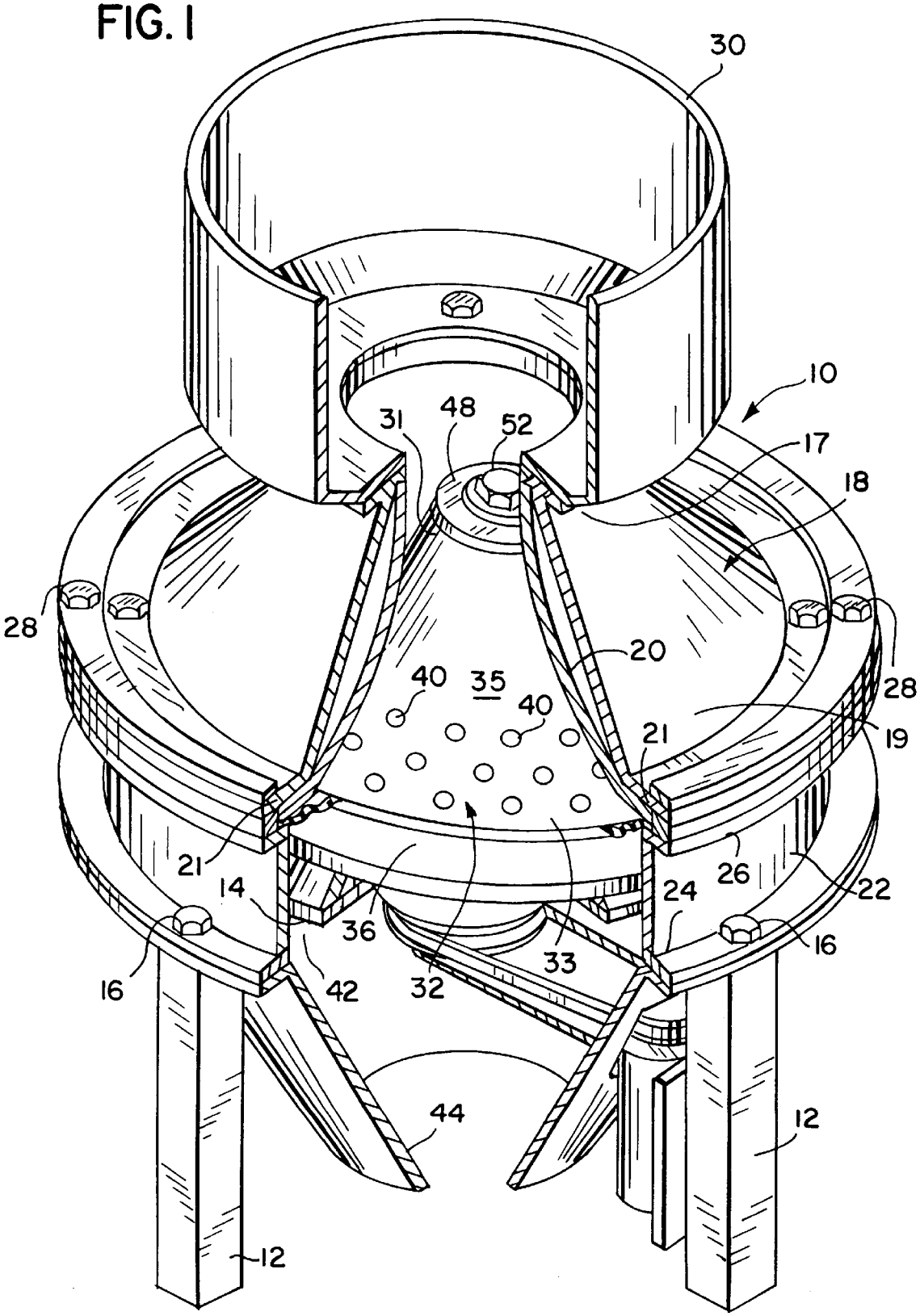
FIG. 1 is a perspective view of a first embodiment of a conical grinder-crusher in accordance with this invention.
Figure 2:
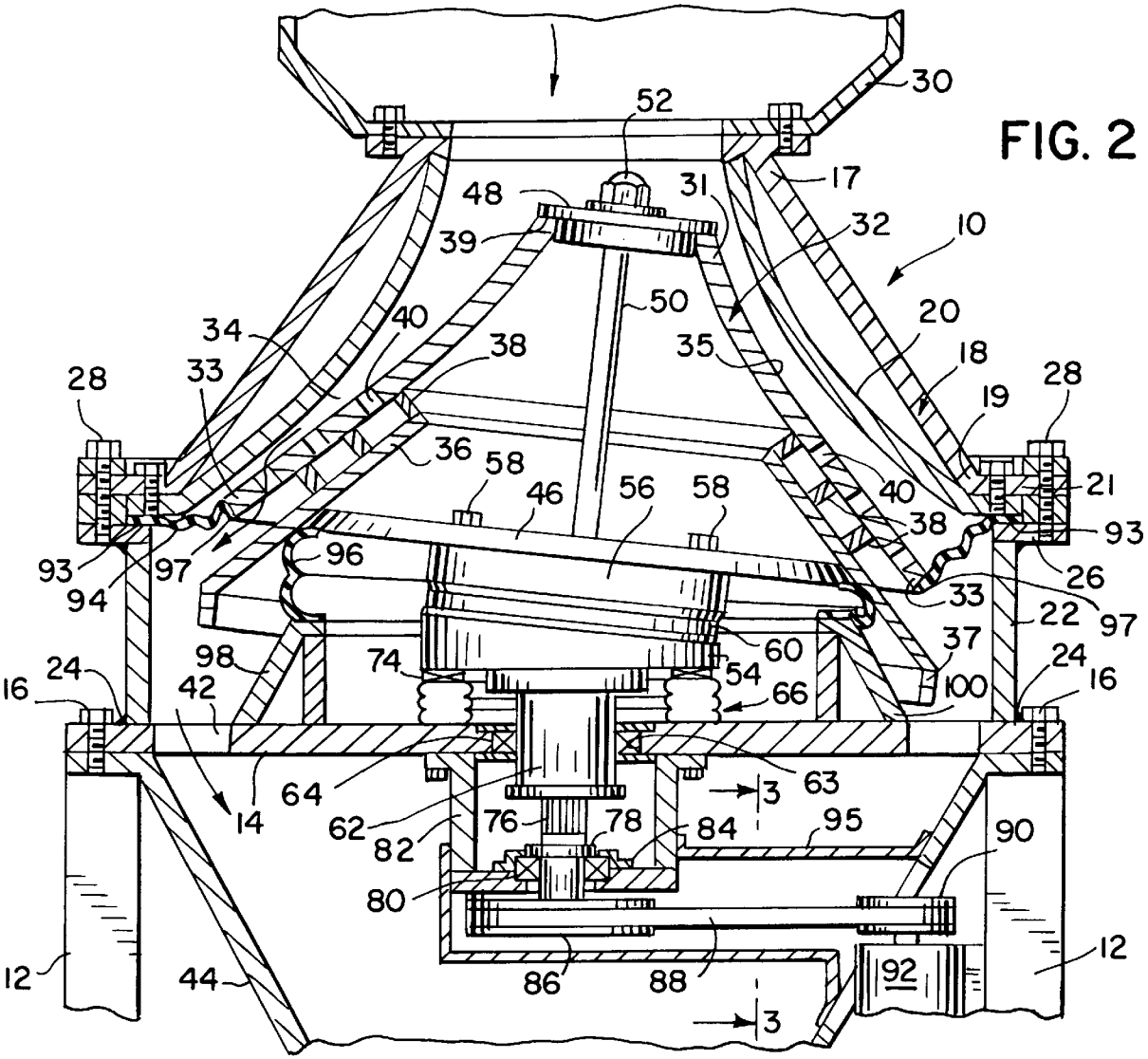
FIG. 2 is a cross-sectional view of a conical grinder-crusher of this invention as shown in FIG. 1.

Referring to FIGS. 1 and 2, a conical grinder-crusher 10 in accordance with this invention is shown supported on foundation pillars 12. The grinder-crusher is assembled on a main support member or bottom plate 14. The bottom plate 14 is secured to the foundation pillars 12 by anchoring means such as bolts 16. While the grinder-crusher is shown supported on pillars 12, it may be supported in any other suitable manner, such as on a cylindrical or rectangular base having opening therein for the servicing of drive components of the grinder-crusher.

The grinder-crusher includes a bowl or frustroconically shaped downwardly spreading outer support member 18 within which is mounted a bowl liner or conically shaped downwardly spreading outer grinder-crusher liner 20. The outer support member 18 has an upper end 17 and a lower end 19. The outer support member 18 and outer grinder-crusher liner 20 are supported from the bottom plate 14 by a cylindrical wall member 22 which is welded at its lower end 24 to the bottom plate 14 and is provided with a flange 26 at the top. The flange 26 is provided with apertures therein, located to coincide with apertures formed in the outer support member 18, to receive fasteners such as bolts 28 to secure the outer support member 18 to the cylindrical wall 22. Located on top of the outer support member 18 and supported thereby is a cover or cylindrical hopper 30 which receives material to be ground, milled, operated on or crushed. The combination of member 18 and liner 20, member 18 alone, liner 20 alone, or adjacent portions of plate 14 or the main frame of grinder-crusher 10 may be considered a bowl assembly.

A crusher head or conically shaped downwardly spreading inner grinding-crushing member 32, which is commonly referred to as a mantle, is supported within the outer grinding-crushing liner 20 so as to form a grinding-crushing cavity 34 therebetween. The grinding-crushing member 32 having an upper end 31, a lower end 33 and a grinding-crushing surface 35 disposed therebetween. Located inside the lower end 33 of the inner grinding-crushing member 32 is a conical support and ground material deflector 36, from which is supported the inner grinding-crushing member 32 by support members 38. A plurality of apertures 40 are provided in the lower end 33 of the inner grinding-crushing member 32, through which ground material is discharged from the grinding-crushing cavity 34 onto the ground material deflector 36. Apertures 40 can be slots, rectangles or other shapes. Apertures 42 are provided in the bottom plate 14 under a lower edge 37 of the ground material deflector 36, such that ground material may fall only into a conical ground material collector 44 located under the bottom plate 14, which directs the ground material to a collection system (not shown).

The ground material deflector 36 is supported on a bottom plate 46. A cap 48 with a hole in the center engages the top edge 39 of a inner grinding-crushing member 32. A securing device 50 in the form of a rod which is secured at its lower end to the bottom plate 46, such as by welding, is provided with a threaded portion (not shown) at its upper end. A fastener 52, in the form of a nut, engages the threaded portion of the rod 50 and presses on the cap 48 and therefore the top edge 39 of the inner grinding-crushing member 32 to secure the inner grinding-crushing member 32 and the ground material deflector 36 to the bottom plate 46.

Referring to FIG. 2 the bottom plate 46 and therefor the conically shaped inner grinding-crushing member 32 is supported on a wobble mechanism which includes a lower cylindrical member 54 and an upper cylindrical member 56. The upper cylindrical member 56 is secured to the bottom plate 46 by fasteners such as bolts 58. A bearing arrangement 60, is interposed between the upper surface of lower member 54 and the lower surface of upper member 56 to permit the upper and lower member to rotate with respect to each other. The lower member 54 is secured to and supported on the upper end of a shaft 62 for rotation therewith. The upper surface of the lower member 54 is in a plane which is not perpendicular to the central axis of the shaft 62. Thus, as the shaft 62 rotates, the upper member 56, which is prevented from rotating, as will hereinafter be described, is caused to wobble as alternately a higher and a lower portion of the upper surface of the lower member 54 passes under a fixed location on the upper member 56.

The shaft 62 passes through an aperture 63 formed in the bottom plate 14 and is supported for rotation therein by a bearing 64. The shaft 62 slides vertically with respect to the inner race of the bearing 64. The shaft 64, lower member 54 and upper member 56 of the wobble mechanism, as well as the inner grinding-crushing member 32, are supported from the bottom plate 14 by an air bellows assembly 66 which is illustrated as an accordion or sinusoidal shaped bellow unit. Alternatively, assembly 66 can be dont shaped bellows stacked one on top of the other. The lower surface of bellows assembly 66 is secured to the bottom plate 14 by suitable securing devices. A ring like bearing assembly 74 is interposed between the top surface of assembly 66 and the lower surface of the lower member 54. The height of the lower member 54 with respect to the bottom plate 14 is adjusted by regulating the air pressure in assembly 66.

Figure 3:
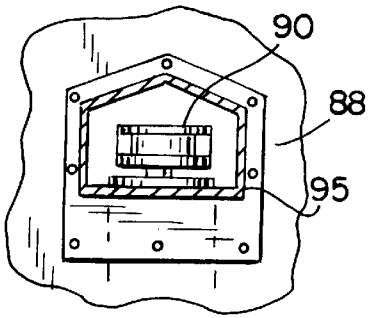
FIG. 3 is a cross-sectional view taken along the line 3—3 in FIG. 2.

The shaft 62 is provided with a splined bore (not shown) which receives an externally splined shaft 76. The shaft 76 is held in a fixed vertical position by an increased diameter portion 78, the lower edge of which rests on a bearing assembly 80. The bearing assembly 80, is secured to a support bracket 82 by clamps 84. Attached to the lower end of the shaft 76 is a pulley 86. The pulley 86 is driven by a belt 88 which engages a pulley 90 driven by a prime mover 92, such as an electric motor. While a pulley and belt drive system is shown, other types of drive systems could be used, such as a pinion and gear drive. Ground material is deflected away from contact with the drive system by an enclosure 95, a cross-section of which is shown in FIG. 3. An extension member 98 is provided between sealing member 96 and plate 14.

The support and gyratory drive for the inner grinding-crushing member 32 is more completely described in U.S. patent application Ser. No. 08/658,650, filed Jun. 5, 1996, which application is assigned to the assignee of this application. The teaching of the aforementioned application is incorporated herein by this reference thereto.

The inner grinding-crushing member 32 is prevented from rotating by a pair of flexible circular shaped bellows or sealing member 94 and 96. A first flexible circular shaped bellows or sealing member 94 is secured along its outer edge 93 to the lower edge 21 of outer grinder-crusher liner 20, and along its inner edge 97 to the lower end 33 of inner grinding-crushing member 32 to prevent ground material from being discharged from the lower end of the grinding cavity 34 and to prevent the inner grinding-crushing member 32 from rotating. The sealing member 94 has enough stretch in it to take up the displacement of the gyration of the inner grinding-crushing member 32 with respect to the outer grinding-crushing liner 20, and also adjustments in the height of the inner grinding member 32 by changing the air pressure in bellows assembly 66. Sealing member 94 is preferably made of rubber, plastic fabric, or other suitable material. The inner grinding-crushing member 32 is also prevented from rotating by flexible circular shaped bellows or sealing member 96 which is secured along its lower edge to a V-shaped frame 100 supported on the bottom plate 14, and along its upper edge to the inner surface of material deflector 36. The sealing member 96 has enough stretch in it to take up the displacement of the gyrating material deflector 36 with respect to the bottom plate 14, and adjustments in the height of the material deflector 36. Not only does the sealing member 96 prevent the inner grinding-crushing member 32 from turning, but it also provides a seal to prevent ground material, and dust therefrom, from reaching the gyratory drive and support members for the inner grinding-crushing member 32.

Turning to the operation of the grinder-crusher, material to be ground is deposited along with a liquid, usually water, into cylindrical hopper 30, through which it flows into the upper end of the grinding-crushing cavity 34 between the outer grinding-crushing liner 20 and the inner grinding-crushing member 32. As the inner grinding member 32 wobbles within the outer grinding-crushing liner 20, the material falls in the grinding-crushing cavity 34 in the region where the grinding-crushing members are more widely spaced and is thereafter ground as the inner and outer members move together. By increasing the air pressure in bellows assembly 66, the inner grinding-crushing member 32 may be raised, so as to move its outer surface closer to the outer grinding-crushing liner 20, thereby resulting in finer grinding-crushing of the material being ground.

The ground material is discharged from the grinding-crushing cavity, along with the liquid, as a slurry through the apertures 40 provided in the lower portion of the inner grinding-crushing member 32. The slurry, including the ground material, which passes through the apertures 40 falls on the ground material deflector 36, and thereafter falls off of the lower edge 37 of deflector 36 toward apertures 42 in the bottom plate 14. The slurry, including the ground material, falling through the apertures 42 falls on conical ground material collector 44 from which it is discharged to a suitable collection system.

The fineness of the ground material discharged from the grinder-crusher may be regulated by adjusting the height of the inner grinding-crushing member 32, through control of air pressure provided to the bellows assembly 66. Raising the inner grinding-crushing member 32 positions it closer to the outer grinding-crushing liner 20, thereby decreasing the width of the grinding-crushing cavity 34.

Figure 4:
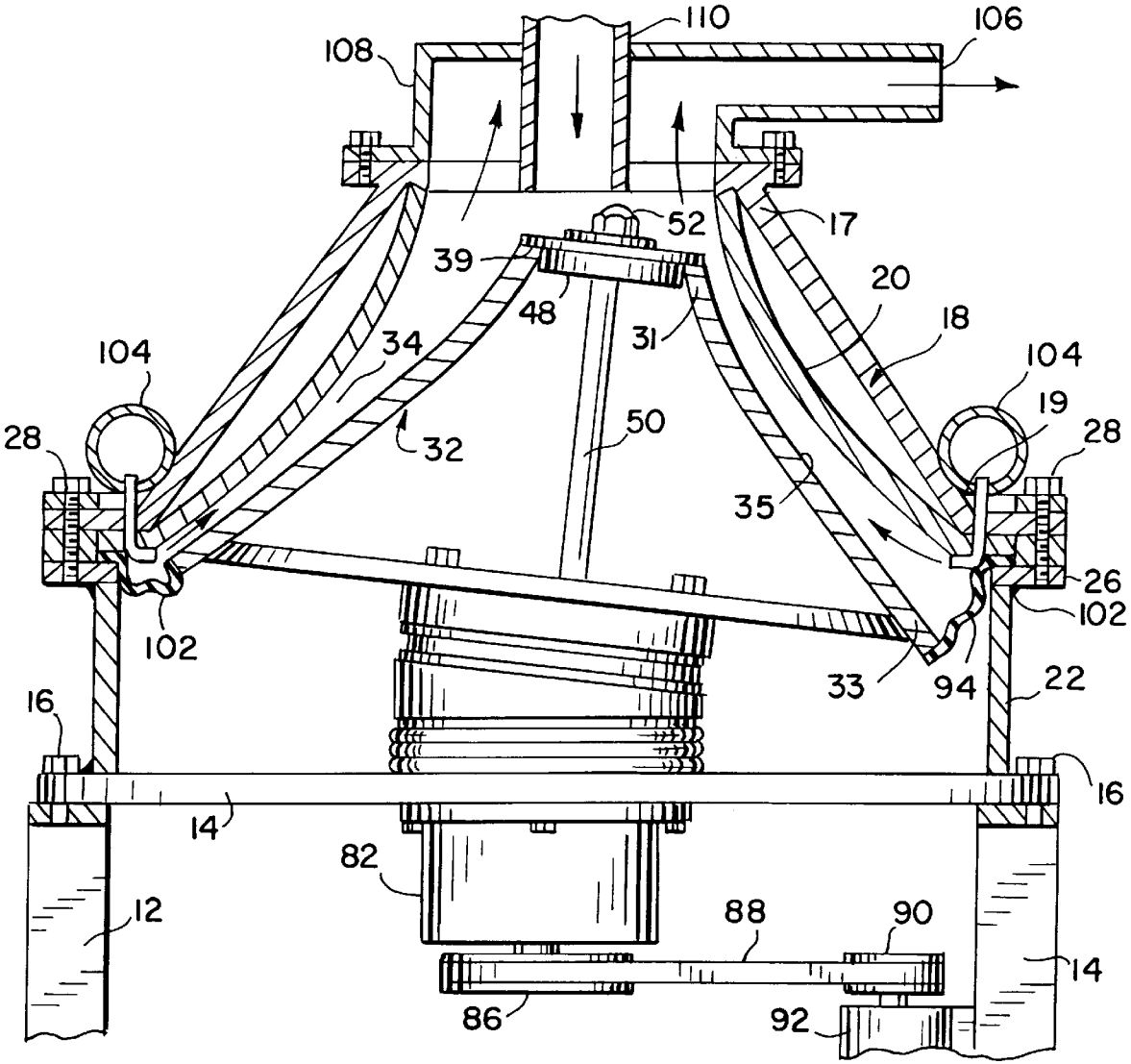
FIG. 4 is a partial cross-sectional view similar to FIG. 2 of a second embodiment of the conical grinder-crusher of this invention.

Referring to FIG. 4, an alternate embodiment of the grinder-crusher of this invention will be described. Elements of the grinder-crusher of the alternate embodiment which are also found in the first embodiment will be identified by the same numerals. The principal difference between the first and alternate embodiment of this invention is the manner in which ground material is discharged from the grinder-crusher. In the alternate embodiment the inner grinding-crushing member 32 is not provided with apertures 40 through which ground material is discharged from the grinding-crushing cavity 34, to a ground material deflector 36 and apertures 42 in the bottom plate 14 to a material collector 44. Rather, fluid discharge nozzles 102 are provided at the lower end of the grinding cavity 34. The fluid discharge nozzles 102 are connected to a supply of pressurized fluid represented by the conduit 104 which encircles the outer support member 18 near its lower end.

With the flexible circular shaped bellows 96 preventing the discharge of ground material from the lower end of the grinding-crushing cavity 34, the pressurized fluid discharged through the nozzles 102 flows upward through the grinding-crushing cavity 34, carrying with it the ground material. The ground material is discharged through an outlet 106 provided in a cylindrical housing 108 secured to the top of the outer support member 18. A cylindrical tube 110 passing through the housing 108 is provided for feeding material to be ground onto the cap 48 and thereafter into the grinding-crushing cavity 34.

Both embodiments of this invention as set forth above may be utilized for either autogenous or semi-autogenous grinding. Autogenous grinding being that done with only the material to be ground being placed in the grinding-crushing cavity of the grinder. Semi-autogenous grinding being that done with both the material to be ground and a grinding media such as coarse ore/pebbles or steel or ceramic pieces, usually shaped as balls. The coarse ore/pebbles being composed of the same material which is to be ground, but being considerably larger in size than the material which is to be ground.

While two embodiments of the invention have been shown, it should be apparent to those skilled in the art that what have been described are considered at present to be preferred embodiments of the conical grinder-crusher of this invention. In accordance with the Patent Statute, changes may be made in the conical grinder-crusher without actually departing from the true spirit and scope of this invention.

The appended claims are intended to cover all such changes and modification which fall in the true spirit and scope of this invention.

What is claimed is:

1. A grinder-crusher comprising:

a main support member;

a conical bowl having an upper end and a lower end, said lower end of said conical bowl supported on said main support member, said conical bowl having an inner grinding-crushing surface;

a conical head, having an upper end and a lower end, said conical head positioned within said conical bowl, said conical head having an outer grinding-crushing surface, said outer grinding-crushing surface of said conical head being spaced from said inner grinding-crushing surface of said conical bowl to form a grinding-crushing cavity therebetween for grinding and crushing material;

a wobble assembly supporting said lower end of said conical head for gyration with respect to said conical bowl;

an adjustable support for supporting said wobble assembly on said main support member, said adjustable support being adjustable to adjust the spacing between said outer grinding-crushing surface of said conical head and said inner grinding-crushing surface of said conical bowl which form said grinding-crushing cavity; and a flexible seal secured to said conical bowl and to said conical head adjacent said lower ends, to prevent the discharge of material from said grinding-crushing cavity between said lower ends, said grinding-crushing cavity being provided with at least one discharge opening, through which ground material is discharged from said grinding-crushing cavity.

2. The grinder-crusher of claim 1, wherein said wobble assembly comprises a lower member and an upper member, each of said members having top and bottom surfaces, said upper member supported for rotation on said lower member by a first bearing assembly located between the top surface of said lower member and said bottom surface of said upper member, said lower member located above said main support member and adjustably spaced therefrom by said adjustable support, said main support member having an aperture therein, a shaft passing through said aperture, said lower member secured to said shaft, such that rotation of said shaft causes rotation of said lower member with respect to said main support member, said top and bottom surfaces of said lower member not being parallel to each other, such that rotation of said lower member with respect to said upper member causes said upper member to wobble, said conical head being supported on said upper member.

3. The grinder-crusher of claim 1, wherein said adjustable support includes an air bellows assembly.

4. The grinder-crusher of claim 1, wherein the conical head is provided with a plurality of apertures adjacent its lower end, a ground material deflector supported by said wobble assembly being located under said apertures in said conical head, and said conical head being supported from said ground material deflector, whereby ground material passes through said plurality of apertures and is deflected by said ground material deflector.

5. The grinder-crusher of claim 4, wherein said main support member has at least one aperture therein, such that said ground material deflected by said ground material deflector passes through said aperture in said main support member.

6. The grinder-crusher of claim 1 wherein a flexible sealing member is provided to form a seal between said conical head adjacent its lower end and said main support member, to prevent ground material from reaching said wobble assembly and said adjustable support.

7. The grinder-crusher of claim 1, further comprising a cover at said upper end of said conical bowl, and wherein fluid discharge nozzles are provided to introduce a fluid into said grinding-crushing cavity at its lower end, and an opening is provided in said cover for the discharge of said fluid and ground material from said grinding-crushing cavity.

8. In a grinder-crusher including a main support member, and a conical bowl supported on the main support member, a conical head comprising:

a grinding-crushing surface having an upper end and a lower end, the conical head receiving a flexible seal adjacent the lower end, said flexible seal adapted to be secured to the conical bowl to prevent material from being discharged at a lower end of the conical bowl and to prevent rotation of the conical head with respect to the conical bowl; and a wobble mechanism coupled to the conical head, the wobble mechanism comprising a lower member and an upper member, each of the members having top and bottom surfaces, the upper member supported for rotation on the lower member by a first bearing assembly located between the top surface of the lower member and the bottom surface of the upper member, the lower member located above the main support member and adjustably spaced therefrom by an adjustable support, the main support member having an aperture therein, a shaft passing through the aperture, the lower member secured to the shaft, such that rotation of the shaft causes rotation of the lower member with respect to the main support member, wherein the top and bottom surfaces of the lower member not being parallel to each other, such that rotation of the lower member with respect to the upper member causes the upper member to wobble, the conical head being supported on the upper member.

9. The conical head of claim 8, wherein the adjustable support includes an air bellows assembly.

10. The conical head of claim 8, wherein the grinding-crushing surface is provided with a plurality of apertures adjacent its lower end, whereby ground material passes through the plurality of apertures past the flexible seal.

11. The conical head of claim 8, wherein a flexible sealing member is provided to form a seal between the conical head adjacent its lower end and the main support member, to prevent ground material from reaching the wobble mechanism and the adjustable support.

12. The conical head of claim 8, wherein a plurality of fluid discharge nozzles are provided to introduce a fluid into a grinding-crushing cavity between the bowl and the head at the lower end of the head, and an opening is provided in a cover adjacent the upper end of the head for the discharge of the fluid and ground material from the grinding-crushing cavity.

13. A grinder-crusher, comprising:

a main frame;

a bowl supported on the main frame, the bowl having an upper end and a lower end;

a grinding-crushing head, having an upper end and a lower end, the grinding-crushing head and the bowl defining a grinding-crushing cavity, the grinding-crushing head having a discharge aperture located above the bottom end of the grinding-crushing head; and a sealing means for stopping material in the grinding-crushing cavity from leaving the grinding-crushing cavity at the lower end of the bowl.

14. The grinder-crusher of claim 13 wherein the sealing means is a bellow member disposed attached to the lower end of the grinding-crushing head.

15. The grinder-crusher of claim 14, wherein the bellow member includes rubber.

16. The grinder-crusher of claim 15, further comprising a wobble mechanism comprising a lower member and an upper member, each of the members having top and bottom surfaces, the upper member supported for rotation on the lower member by a first bearing assembly located between the top surface of the lower member and the bottom surface of the upper member, the lower member located above the main support member and adjustably spaced therefrom by an adjustable support, the main frame having an aperture therein, a shaft passing through the aperture, the lower member secured to the shaft, such that rotation of the shaft causes rotation of the lower member with respect to the main frame; and the top and bottom surfaces of the lower member not being parallel to each other, such that rotation of the lower member with respect to the upper member causes the upper member to wobble, the grinding-crushing head being supported on the upper member.

17. The grinder-crusher of claim 16, wherein the adjustable support includes an air bellows assembly.

18. The grinder-crusher of claim 13, wherein the grinding-crushing head is provided with a plurality of apertures adjacent its lower end, whereby material in the grinding-crushing cavity passes through the plurality of apertures past the sealing means.

19. The grinder-crusher of claim 18 wherein the sealing means is provided to form a seal between the grinding-crushing head adjacent its lower end and the bowl adjacent its lower end.

* * * * *